US012312779B2

(12) United States Patent
Morton et al.

(10) Patent No.: US 12,312,779 B2
(45) Date of Patent: May 27, 2025

(54) FLUSH VALVE WATER SUPPLY HOSE BIBB

(71) Applicants: Chad Morton, Phoenix, AZ (US); Sherry Morton, Phoenix, AZ (US)

(72) Inventors: Chad Morton, Phoenix, AZ (US); Sherry Morton, Phoenix, AZ (US)

( * ) Notice: Subject to any disclaimer, the term of this patent is extended or adjusted under 35 U.S.C. 154(b) by 75 days.

(21) Appl. No.: 18/537,909

(22) Filed: Dec. 13, 2023

(65) Prior Publication Data

US 2024/0240439 A1 Jul. 18, 2024

Related U.S. Application Data

(60) Provisional application No. 63/480,115, filed on Jan. 17, 2023.

(51) Int. Cl.
*E03B 7/07* (2006.01)
*E03D 5/10* (2006.01)

(52) U.S. Cl.
CPC . *E03B 7/07* (2013.01); *E03D 5/10* (2013.01)

(58) Field of Classification Search
CPC ..... E03B 7/07; E03D 5/10; E03D 5/105
See application file for complete search history.

(56) References Cited

U.S. PATENT DOCUMENTS 6,973,679 B1 * 12/2005 Schad ..... E03D 9/085 4/443
2019/0234058 A1 * 8/2019 Shakkour ..... E03D 5/10

FOREIGN PATENT DOCUMENTS

FR 2923227 A1 * 5/2009 ..... E03C 1/023
JP 2004316097 A * 11/2004

OTHER PUBLICATIONS

YouTube video "Installing a Sloan Auto Flush Valve" posted by user "123tom" on Feb. 1, 2016, Retrieved from Internet: < https://youtu.be/vyukNsQIGOg?si=RiEc0sSshbsNcc9O> (Year: 2016).*
YouTube video "Flushometer Tailpiece Removal Instruction" posted by user "Sloan" on Dec. 19, 2019, Retrieved from Internet: < https://youtu.be/KXZV3E7gcdM?si=fkyPviVMEK9phYPH> (Year: 2019).*
SloanRepair.com Blog Post "Sloan Control Stop Guide" posted on Feb. 5, 2020, Retrieved from Internet: <https://sloanrepair.com/blogs/blog/sloan-control-stop-guide> (Year: 2020).*

* cited by examiner

*Primary Examiner* — Marina A Tietjen
(74) *Attorney, Agent, or Firm* — Bruce A. Lev

(57) ABSTRACT

A flush valve water supply hose bibb adapted to replace an automatic flush valve, and the method of removing an automatic flush valve from an existing plumbing fixture and installing the water supply hose bibb in its place, to thereby provide a direct water source to a commercial restroom for maintenance servicing and cleaning purposes.

2 Claims, 6 Drawing Sheets

FLUSH VALVE WATER SUPPLY HOSE BIBB

CROSS-REFERENCE TO RELATED APPLICATION

The present application is related to and claims priority from prior provisional application Ser. No. 63/480,115, filed Jan. 17, 2023 which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to flush valve water supply bibbs, and more specifically to the method of removing an automatic flush valve from an existing plumbing fixture and installing a water supply hose bibb in its place.

2. Description of the Related Art

Most prior art commercial restrooms do not have a direct water source for cleaning the restrooms or cleaning out the toilet and urinal fixtures. In many instances, they do have a flush valve attached to an existing plumbing fixture supplying water therethrough to a toilet or urinal fixture. The instant invention will take an existing plumbing flush valve and convert it into an on-demand water supply hose bibb. This in turn will supply a hose hookup to any fixture it is attached to.

Accordingly, the present invention overcomes the disadvantages associated with the prior art, by providing a drinking vessel that includes a plurality of spaced protrusions permanently attached to and extending inwardly from a position spaced from the top rim of the drinking vessel and that are adapted to allow liquids to pass thereby and out of the interior volume of the drinking vessel and at the same time block ice cubes from passing thereby and out of the interior volume, such that a user can drink the liquid without having ice cubes enter their mouth as well.

BRIEF SUMMARY OF THE INVENTION

In view of the foregoing cleaning disadvantages inherent in the known types of commercial restrooms, the instant invention provides a flush valve water supply hose bibb adapted to replace an automatic flush valve, and the method of removing an automatic flush valve from an existing plumbing fixture and installing the water supply hose bibb in its place, to thereby provide a direct water source to a commercial restroom for maintenance servicing and cleaning purposes, with all the advantages of the prior art and none of the disadvantages.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

Figure 1:
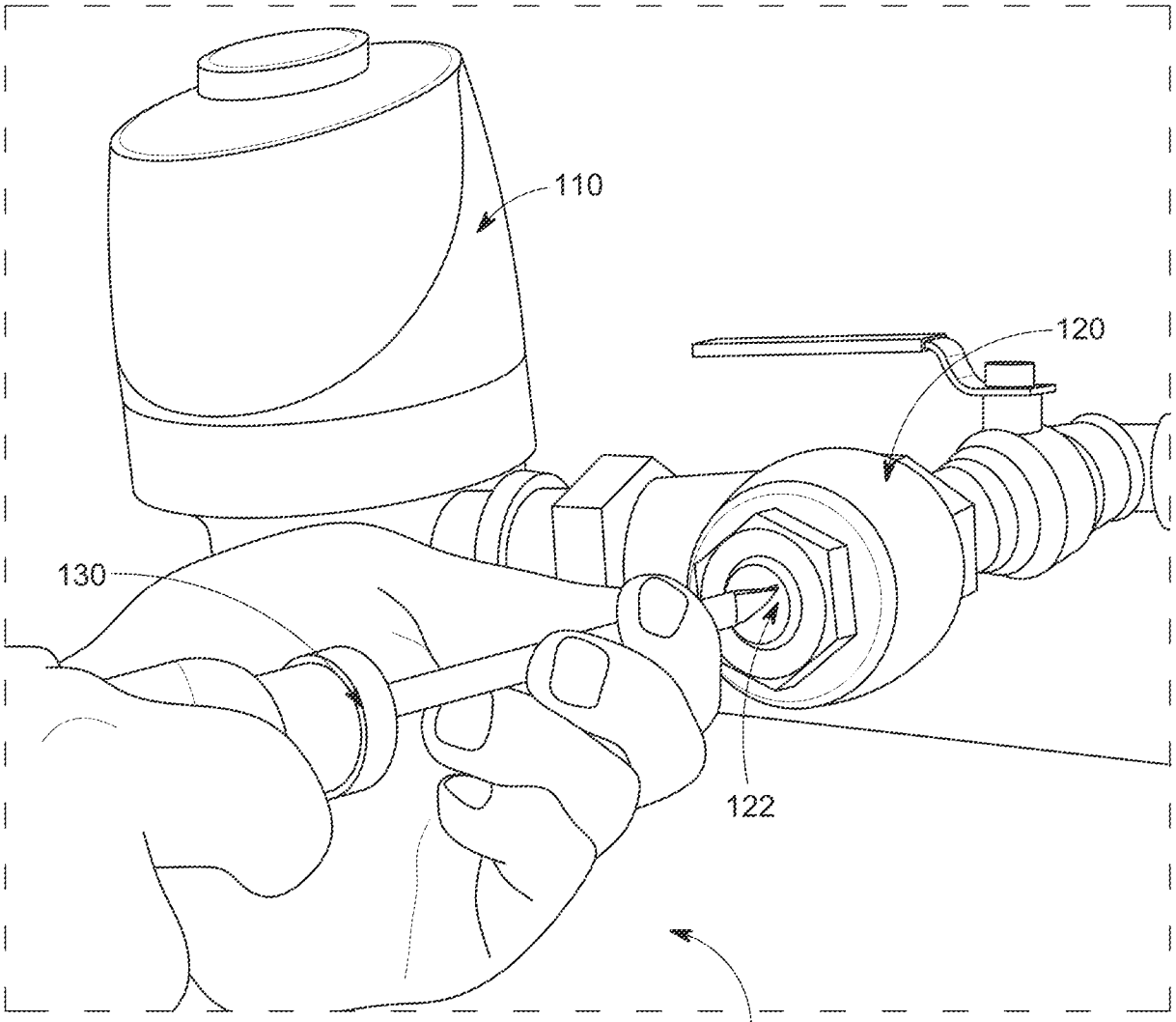
FIG. 1 shows a perspective view of the step of using a flat head screwdriver to turn off the water supply through an existing plumbing fixture to an automatic flush valve according to the preferred embodiment of the present invention.
Figure 2:
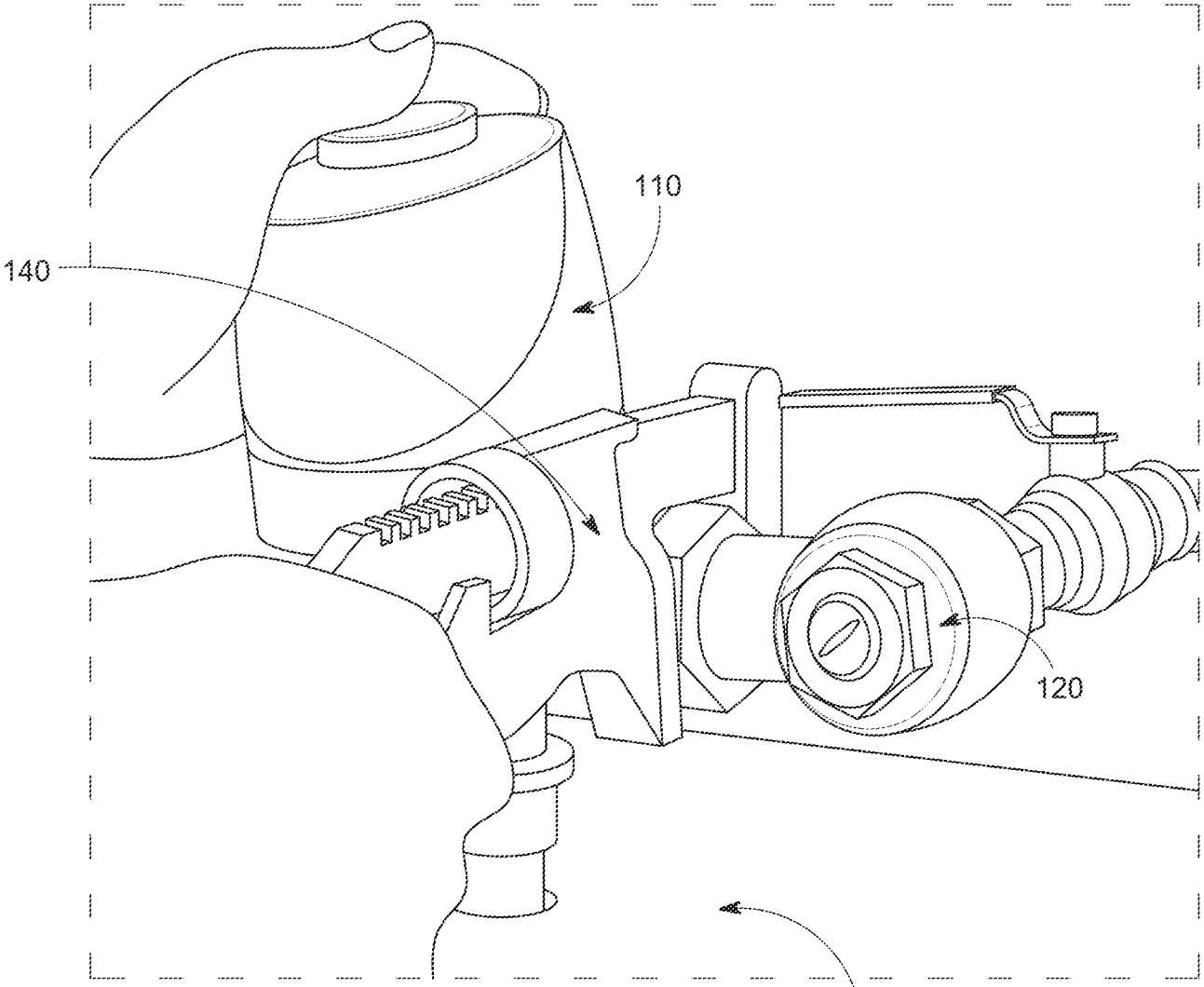
FIG. 2 shows a perspective view of the step of using a wrench to loosen and remove the automatic flush valve from the existing plumbing fixture according to the preferred embodiment of the present invention.
Figure 3:
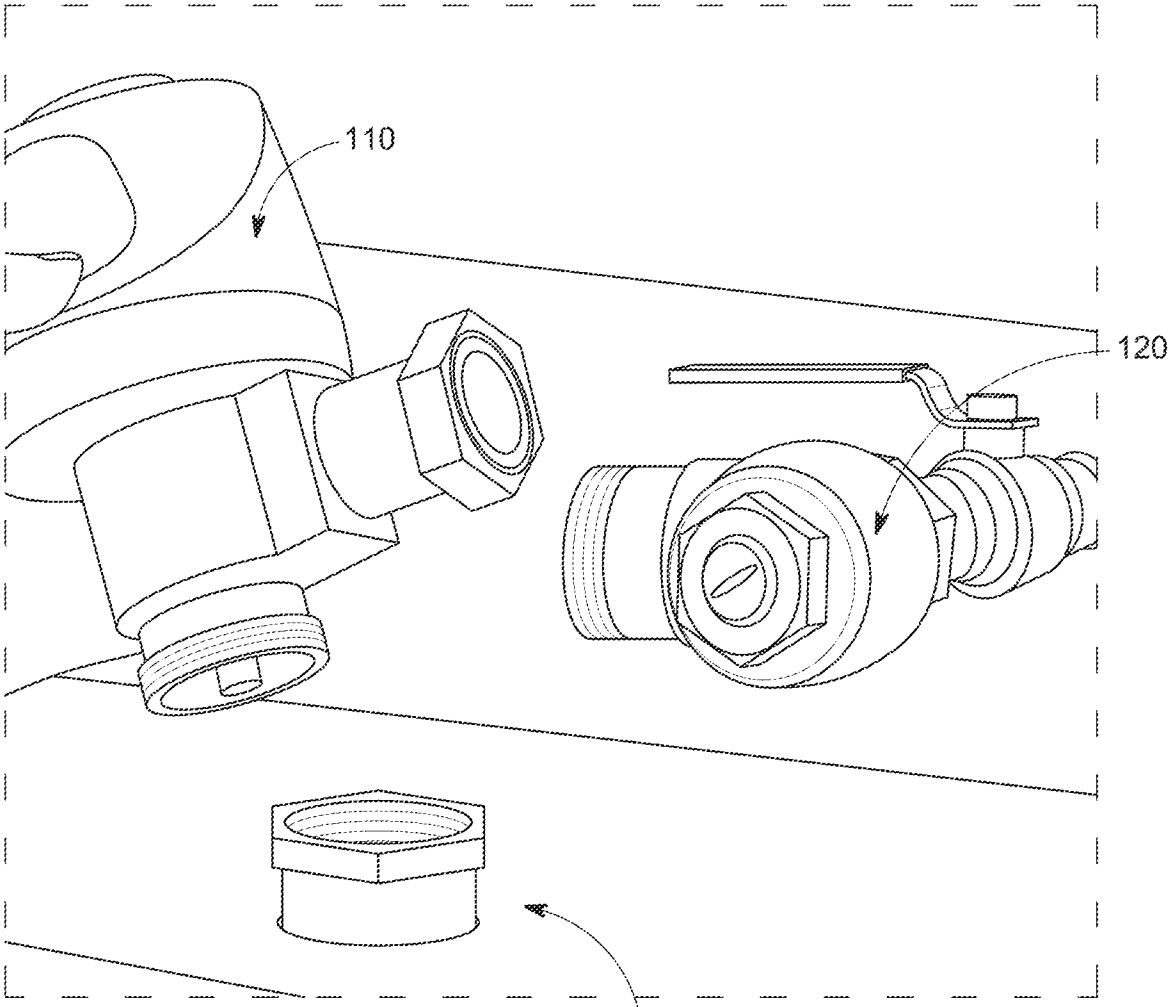
FIG. 3 shows a perspective view of the step of removing the automatic flush valve from the existing plumbing fixture according to the preferred embodiment of the present invention.
Figure 4:
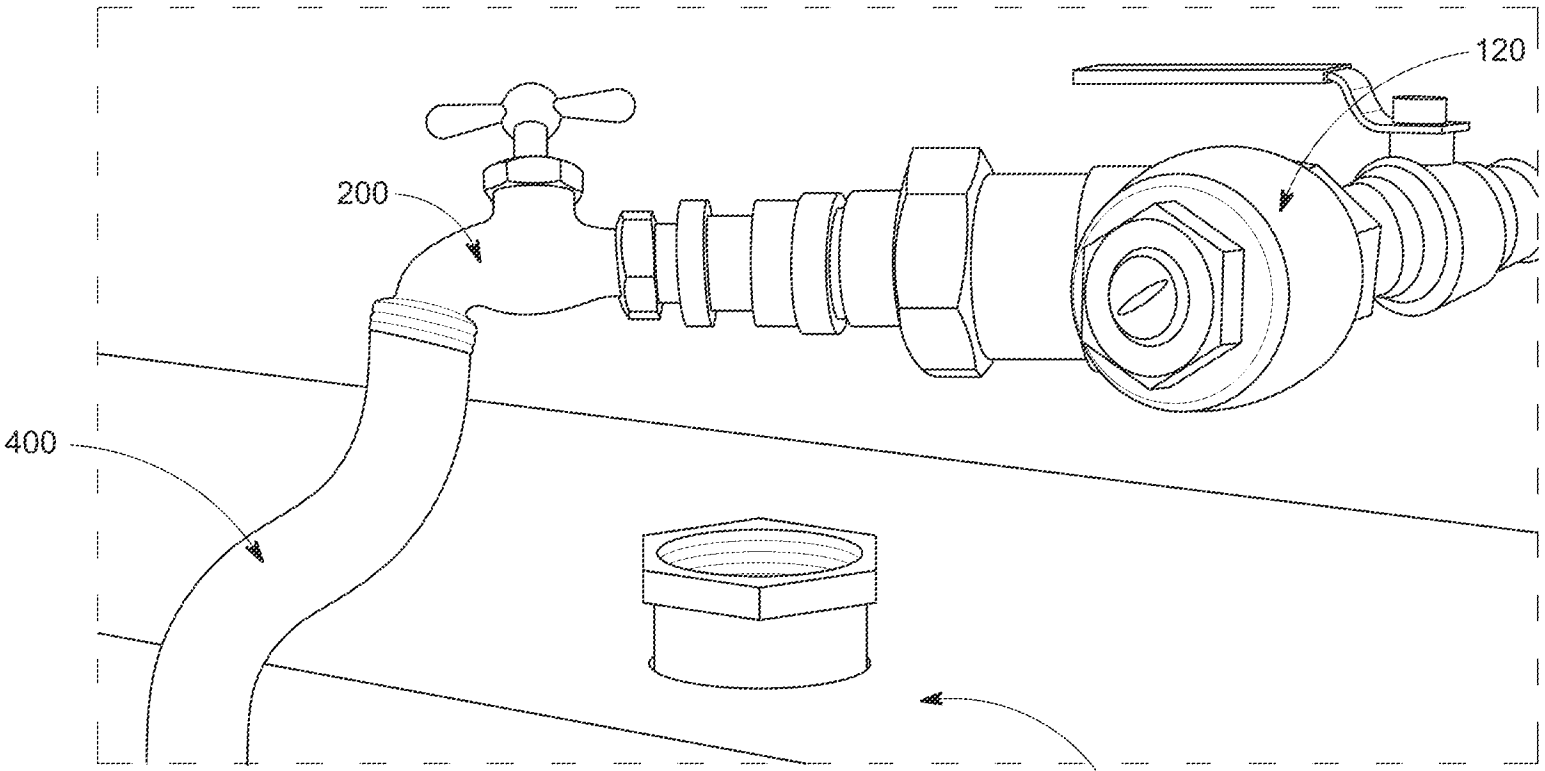
FIG. 4 shows a perspective view of the step attaching a flush valve water supply bibb to the existing plumbing fixture according to the preferred embodiment of the present invention.
Figure 5:
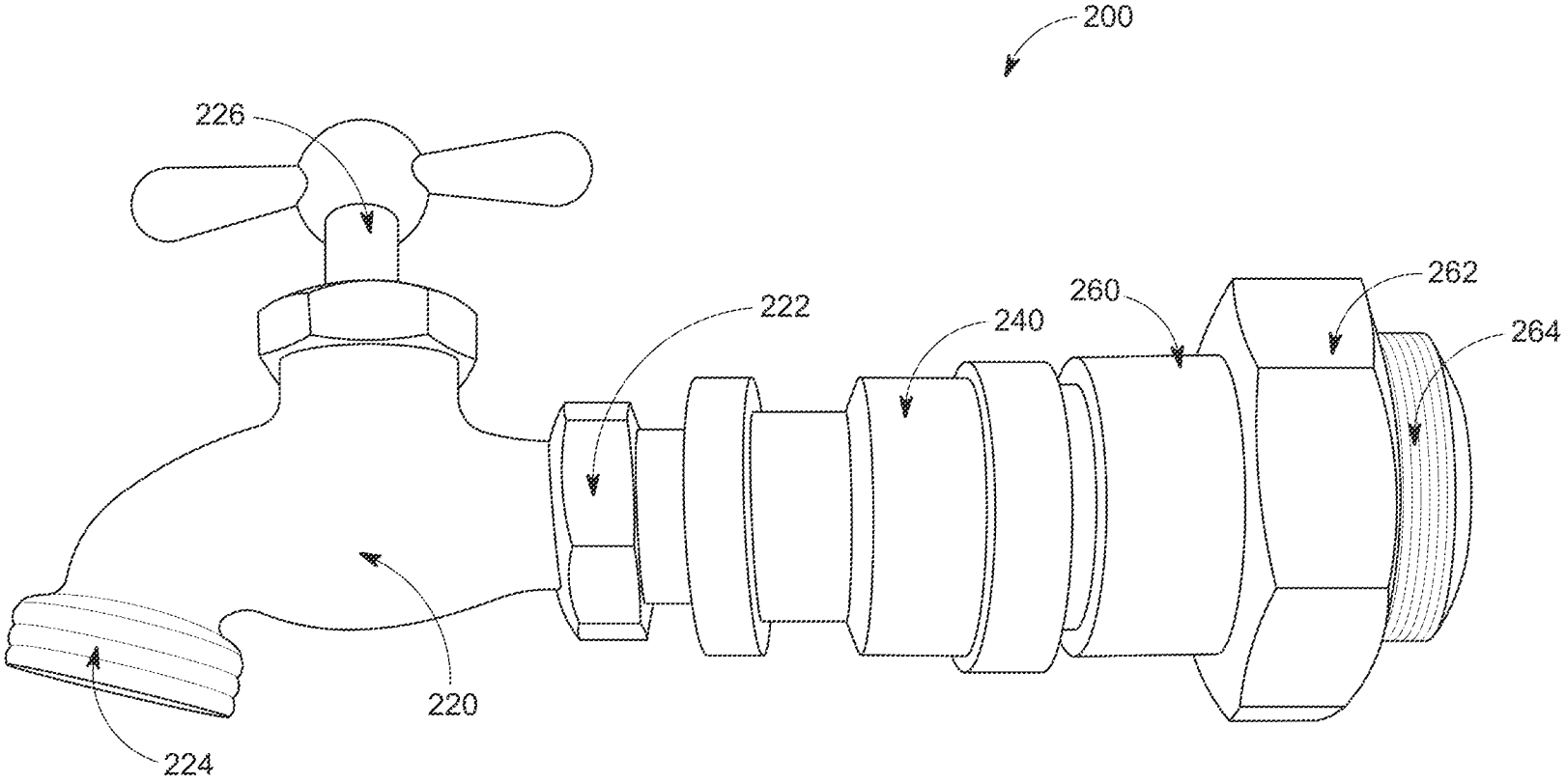
FIG. 5 shows side view of the flush valve water supply bibb according to the preferred embodiment of the present invention.
Figure 6:
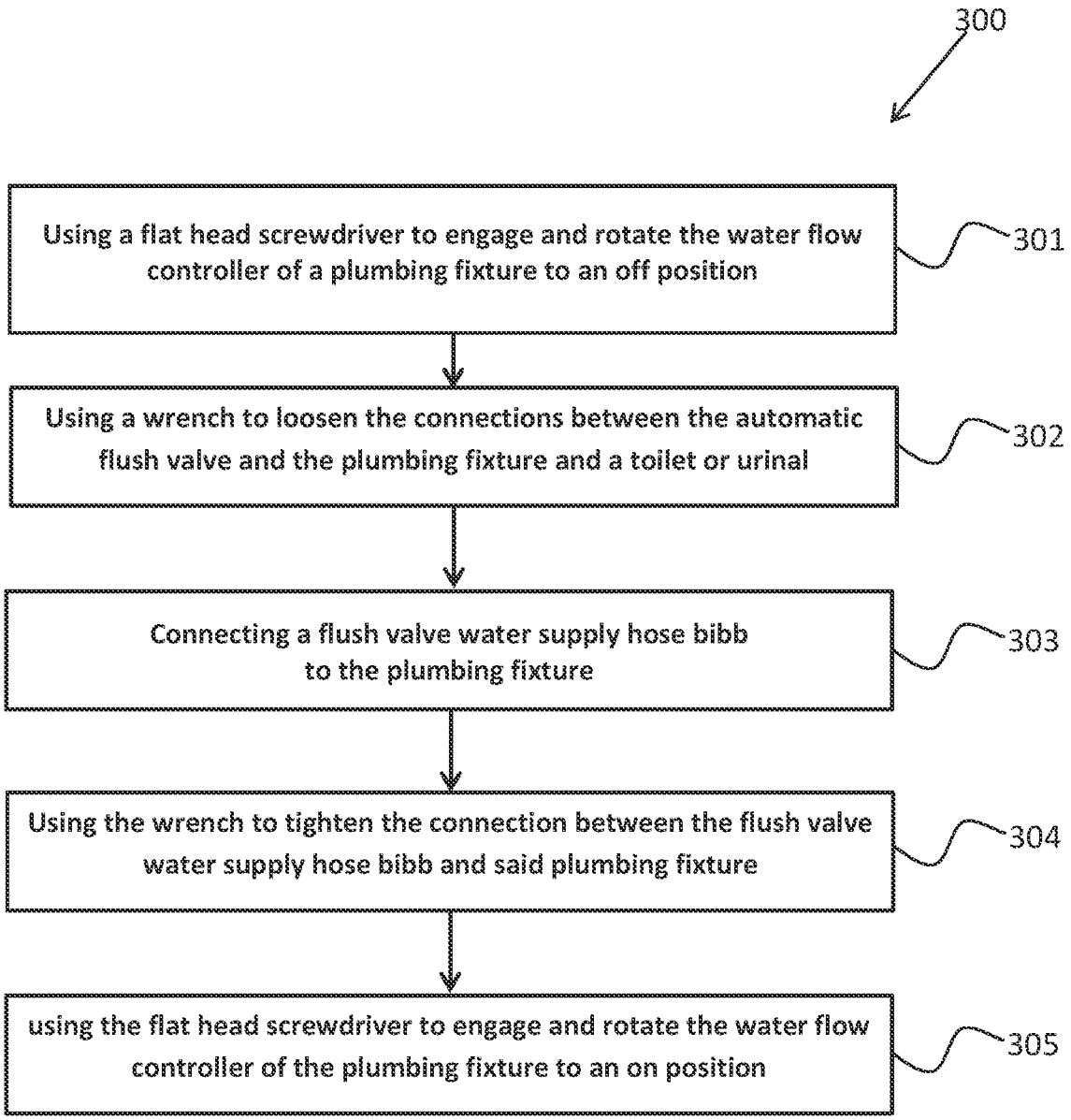
FIG. 6 shows a flow chart of method steps for removing an automatic flush valve from an existing plumbing fixture and installing a flush valve water supply hose bibb in its place according to the preferred embodiment of the present invention.

Turning now descriptively to drawing, referring to FIGS. 1-6, the present invention discloses a method 300 of removing an automatic flush valve 110 from a plumbing fixture 120 and installing a flush valve water supply hose bibb 200 in its place, comprising the steps of 301, providing a flat head screwdriver 130 and using it to engage and rotate a water flow controller 122 of the plumbing fixture 120 to an off position, thereby shutting off water flow to the automatic flush valve 110 connected thereto; 302, using a wrench 140 to loosen the connections between the automatic flush valve 110 and the plumbing fixture 120 and a toilet or urinal 150; removing the automatic flush valve 110 from said plumbing fixture 120 and said toilet or urinal 150; 303, connecting a flush valve water supply hose bibb 200 to the plumbing fixture 120; 304, using the wrench to tighten the connection between the flush valve water supply hose bibb 200 and the plumbing fixture 120; 305, using the flat head screwdriver to engage and rotate the water flow controller 122 of the plumbing fixture 120 to an on position, thereby allowing water to flow to the flush valve water supply hose bibb 200.

The flush valve water supply hose bibb 200 includes a hollow body portion 220 having a handle 226 movably connected to the body portion and is adapted to control water flow through the flush valve water supply hose bibb 200, a threaded inlet fitting 222 located on a proximal end of the body portion 220, and a threaded outlet fitting 224 located on a distal end of the body portion 220. The flush valve water supply hose bibb 200 further includes a hollow connector 260 having a threaded end 264 adapted to be removably connect with the plumbing fixture 120, and a tightening flange 262 adapted to be engaged by the wrench 140 to thereby rotate the connector 260 to thereby releasably connect with the plumbing fixture 120. The flush valve water supply hose bibb 200 further includes a hollow adapter 240 adapted to be connected to and between the connector 260 and the body portion 220, such that the flush valve water supply hose bibb 200 is adapted to be releasably connected to the plumbing fixture 120 and allowing water to flow therethrough.

When in use, a hose 400, or any other like attachments, can be attached to the threaded outlet fitting 224 of the flush valve water supply hose bibb 200 for maintenance servicing and cleaning purposes of commercial restrooms.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A method of removing an automatic flush valve from a plumbing fixture and installing a flush valve water supply hose bibb in its place, comprising the steps of:

a. providing a flat head screwdriver;

b. using said flat head screwdriver to engage and rotate a water flow controller of said plumbing fixture to an off position, thereby shutting off water flow to said automatic flush valve connected thereto;

c. providing a wrench;

d. using said wrench to loosen the connections between said automatic flush valve and said plumbing fixture and a toilet or urinal;

e. removing said automatic flush valve from said plumbing fixture and said toilet or urinal;

f. providing a flush valve water supply hose bibb;

g. connecting said flush valve water supply hose bibb to said plumbing fixture;

h. using said wrench to tighten the connection between said flush valve water supply hose bibb and said plumbing fixture;

i. using said flat head screwdriver to engage and rotate said water flow controller of said plumbing fixture to an on position, thereby allowing water to flow to said flush valve water supply hose bibb.

2. The method of claim 1, wherein said flush valve water supply hose bibb comprises:

a hollow body portion including:

a handle;

wherein said handle is movably connected to said body portion and is adapted to control water flow through said flush valve water supply hose bibb;

a threaded inlet fitting;

wherein said threaded inlet fitting is located on a proximal end of said body portion; and a threaded outlet fitting;

wherein said threaded outlet fitting is located on a distal end of said body portion;

a hollow connector including:

a threaded end;

wherein said threaded end is adapted to be removably connect with said plumbing fixture; and a tightening flange;

wherein said tightening flange is adapted to be engaged by said wrench to thereby rotate said connector to thereby releasably connect with said plumbing fixture; and a hollow adapter;

wherein said adapter is adapted to be connected to and between said connector and said body portion;

wherein said flush valve water supply hose bibb is adapted to be releasably connected to said plumbing fixture and allowing water to flow therethrough.

* * * * *